US007581653B2

(12) United States Patent
Perrin et al.

(10) Patent No.: US 7,581,653 B2
(45) Date of Patent: Sep. 1, 2009

(54) CAP AND CLOSURE SYSTEM FOR CLOSING A LARGE POTABLE LIQUID BOTTLE

(75) Inventors: Gerard Perrin, Meyzieu (FR); Henri Pionchon, Lyons (FR)

(73) Assignee: Crealise Packaging-Conditionnement Inc., Rawdon (CA)

( * ) Notice: Subject to any disclaimer, the term of this patent is extended or adjusted under 35 U.S.C. 154(b) by 628 days.

(21) Appl. No.: 10/822,211

(22) Filed: Apr. 8, 2004

(65) Prior Publication Data

US 2005/0224446 A1 Oct. 13, 2005

(51) Int. Cl.
*B65D 41/48* (2006.01)

(52) U.S. Cl. ..... 215/254; 215/253

(58) Field of Classification Search ..... 215/254, 215/253, 256, 250; 206/432, 497; 220/270, 220/268

See application file for complete search history.

(56) References Cited

U.S. PATENT DOCUMENTS

| | | | | |
|---|---|---|---|---|
| 1,976,007 | A | 10/1934 | Cullen et al. | |
| 2,213,465 | A | 9/1940 | Gay | |
| 2,811,272 | A | 10/1957 | Lawlor | |
| 3,392,862 | A * | 7/1968 | Faulstich | 215/254 |
| 3,840,137 | A * | 10/1974 | Faulstich | 215/256 |
| 3,940,103 | A | 2/1976 | Hilaire | |
| 4,239,130 | A | 12/1980 | Altadonna | |
| 4,243,150 | A | 1/1981 | Gunne et al. | |
| 4,267,945 | A | 5/1981 | Maynard, Jr. | |
| 4,597,423 | A | 7/1986 | Chenot | |
| RE32,354 | E | 2/1987 | Savage | |
| 4,699,188 | A | 10/1987 | Baker et al. | |
| 4,717,051 | A | 1/1988 | Leclere | |
| 4,735,337 | A * | 4/1988 | Von Holdt | 220/276 |
| 4,834,267 | A | 5/1989 | Schroer et al. | |
| 4,846,236 | A | 7/1989 | Deruntz | |

(Continued)

FOREIGN PATENT DOCUMENTS

| | | |
|---|---|---|
| CA | 1 291 969 | 11/1991 |

(Continued)

*Primary Examiner*—Robin Hylton
(74) *Attorney, Agent, or Firm*—Miller, Matthias & Hull

(57) ABSTRACT

A threadless cap for closing a potable liquid bottle is provided. The potable liquid bottle has a neck with an upper edge defining a discharge opening. The threadless cap comprises a lid for overlying and sealingly engaging the upper edge of the neck. The lid includes a tension ring for retaining the cap on the neck of the bottle, the tension ring having an inwardly extending rib for engaging the neck of the bottle. The threadless cap also comprises a skirt depending from the lid, the skirt including a line of weakness facilitating a manual tear of the skirt. The threadless cap further comprises a tear stop at a location intersecting a line of tear propagating as a result of a manual pull applied on the skirt, the tear stop preventing the line of tear to propagate beyond the tear stop. The line of weakness may include a portion extending across the tension ring to reduce a retaining force exerted by the tension ring on the neck of the bottle when a tear line propagating as a result of a manual pull applied on the skirt extends across the tension ring. Also, provided is a closure system that includes such a threadless cap and a protective sheath for application on the cap.

34 Claims, 4 Drawing Sheets

U.S. PATENT DOCUMENTS

| | | | | | |
|---|---|---|---|---|---|
| 4,911,316 | A | * | 3/1990 | Tackles | 215/256 |
| 4,934,546 | A | * | 6/1990 | Markley | 215/256 |
| 4,948,009 | A | | 8/1990 | Sawatani | |
| 5,031,676 | A | | 7/1991 | Ulm | |
| 5,121,778 | A | | 6/1992 | Baker et al. | |
| 5,222,519 | A | | 6/1993 | Sato et al. | |
| 5,222,530 | A | | 6/1993 | Baker et al. | |
| 5,232,125 | A | | 8/1993 | Adams | |
| 5,259,534 | A | | 11/1993 | Lynd | |
| 5,273,083 | A | | 12/1993 | Burrows | |
| 5,284,188 | A | | 2/1994 | Baker et al. | |
| 5,289,854 | A | | 3/1994 | Baker et al. | |
| 5,289,855 | A | | 3/1994 | Baker et al. | |
| 5,295,518 | A | | 3/1994 | Baker et al. | |
| 5,297,599 | A | | 3/1994 | Bucheli | |
| 5,370,270 | A | | 12/1994 | Adams et al. | |
| 5,397,023 | A | | 3/1995 | Toczek et al. | |
| 5,513,763 | A | | 5/1996 | Adams et al. | |
| 5,542,555 | A | | 8/1996 | Hidding et al. | |
| 5,687,865 | A | * | 11/1997 | Adams et al. | 215/253 |
| 5,687,867 | A | | 11/1997 | Lamoureux | |
| 5,909,827 | A | | 6/1999 | Bietzer et al. | |
| 5,937,921 | A | * | 8/1999 | Guglielmini | 141/351 |
| 6,032,812 | A | | 3/2000 | Lamoureux | |
| 6,177,041 | B1 | | 1/2001 | Bietzer | |
| 6,681,947 | B2 | * | 1/2004 | Kim et al. | 215/254 |
| 2003/0094213 | A1 | | 5/2003 | Moon et al. | |

FOREIGN PATENT DOCUMENTS

| | | | |
|---|---|---|---|
| CA | 1 338 210 | | 4/1996 |
| CA | 1 338 339 | | 5/1996 |
| CA | 2 181 828 | | 1/2002 |
| CA | 2 442 213 | | 10/2002 |
| CA | 2 418 456 | | 8/2004 |
| EP | 0 918 731 | B1 | 6/1997 |
| FR | 2 822 810 | A1 | 3/2001 |
| GB | 1 104 638 | | 3/1966 |
| WO | WO 90/03919 | | 4/1990 |
| WO | WO 91/13813 | | 9/1991 |
| WO | WO 93/07084 | | 4/1993 |
| WO | WO 94/29215 | | 12/1994 |
| WO | WO 98/03426 | | 1/1998 |
| WO | WO 00/40474 | A1 * | 7/2000 |
| WO | WO 02/060808 | A1 | 8/2002 |
| WO | WO 02/079046 | A1 | 10/2002 |
| WO | WO 2004/071932 | A1 | 8/2004 |

* cited by examiner

CAP AND CLOSURE SYSTEM FOR CLOSING A LARGE POTABLE LIQUID BOTTLE

FIELD OF THE INVENTION

The present invention relates to a threadless cap for closing a potable liquid bottle, such as a water bottle for a water dispenser, and to a closure system including such a threadless cap.

BACKGROUND OF THE INVENTION

A potable liquid bottle, such as a water bottle for a water cooler or similar dispenser, is usually provided with a cap to close and seal a discharge opening on the neck of the bottle during storage, transportation, and manipulation of the bottle. Of course, other than water, the potable liquid contained in the bottle can also be juice, soft drink, or any other type of drinkable liquid.

The cap prevents inadvertent spilling of liquid from the bottle and contamination of the liquid by exposure to the environment. The cap also ensures that hygienic conditions exist on surfaces of the neck of the bottle and around the discharge opening on which liquid flowing out of the bottle will come into direct contact with. Typically, the cap is made of a polymeric material and includes a tension ring or the like that provides a radial force for retaining the cap on the neck of the bottle. The cap also generally includes a line of weakness that facilitates tearing or rupturing of the cap material by a manual pull when the cap is to be removed from the bottle.

Frequently, however, a tear of the cap material propagating along the line of weakness propagates along the entire periphery of the cap, which causes a first portion of the cap on which the manual pull is applied to be completely detached from a second portion of the cap which remains fixed on the neck of the bottle. In other words, conventional caps do not include any means to prevent complete separation of the first portion of the cap on which the manual pull is applied from the second portion. It then becomes difficult to remove the second portion remaining on the neck of the bottle since there no longer is sufficient cap material to provide a grip to apply the manual pull. Moreover, the difficulty in removing the cap is compounded by the presence of the tension ring which usually remains on the cap as part of the second portion. In fact, even without the difficulty arising from complete separation of the first and second portions of the cap, conventional caps do not include any means to reduce the retaining force exerted by the tension ring on the neck of the bottle when the cap is to be removed from the bottle, which often creates unnecessary difficulty in removing the cap.

In addition, in order to complement the hygienic conditions ensured by the cap, a protective sheath, sleeve, or wrap made of a polymeric material is sometimes used to cover a portion of the neck of the bottle and the cap. The protective sheath typically covers the entire cap and a portion of the neck of the bottle below the cap, since these elements are the ones most frequently contacted during manipulation of the bottle.

Now, the neck of the bottle generally has an annular recessed area below the upper edge of the neck. However, the dimensions of a conventional cap are such that the cap extends beyond the lower limit of the annular recessed area of the neck. As a result, the protective sheath essentially conforms to the outer surface of the cap and is prevented from conforming to at least a portion of the annular recessed area of the neck. The resulting configuration of the protective sheath is such that there is a tendency for axial sliding of the protective sheath on the cap and on the portion of the neck of the bottle below the cap during manipulation of the bottle. In turn, the axial sliding of the protective sheath can lead to an increase in the area of the neck of the bottle and the cap that is exposed to direct contact with human hands during manipulation of the bottle, which is detrimental to the hygienic conditions of the bottle.

While various solutions to the above problems have been proposed, none of these is satisfactory and thus there remains a need in the industry to provide a threadless cap for closing a potable liquid bottle that alleviates at least in part the problems associated with existing caps.

SUMMARY OF THE INVENTION

In accordance with a first broad aspect, the invention provides a threadless cap for closing a potable liquid bottle. The potable liquid bottle has a neck with an upper edge defining a discharge opening. The threadless cap comprises a lid for overlying and sealingly engaging the upper edge of the neck. The lid includes a tension ring for retaining the cap on the neck of the bottle, the tension ring having an inwardly extending rib for engaging the neck of the bottle. The threadless cap also comprises a skirt depending from the lid, the skirt including a line of weakness facilitating a manual tear of the skirt. The threadless cap further comprises a tear stop at a location intersecting a line of tear propagating as a result of a manual pull applied on the skirt, the tear stop preventing the line of tear to propagate beyond the tear stop.

In accordance with a second broad aspect, the invention provides a threadless cap for closing a potable liquid bottle. The potable liquid bottle has a neck with an upper edge defining a discharge opening. The threadless cap comprises a lid for overlying and sealingly engaging the upper edge of the neck. The lid includes a tension ring for retaining the cap on the neck, the tension ring having an inwardly extending rib for engaging the neck of the bottle. The threadless cap also comprises a skirt depending from the lid, the skirt including a line of weakness facilitating a manual tear of the skirt. The line of weakness includes a portion extending across the tension ring to reduce a retaining force exerted by the tension ring on the neck of the bottle when a tear line propagating as a result of a manual pull applied on the skirt extends across the tension ring.

In accordance with a third broad aspect, the invention provides a closure system for a potable liquid bottle. The potable liquid bottle has a neck having an upper edge defining a discharge opening and an annular recessed area below the upper edge, the annular recessed area having an upper end portion and a lower end portion. The closure system comprises a threadless cap having a lid for overlying and sealingly engaging the upper edge. The threadless cap also has a skirt depending from the lid, the skirt having a lower edge. The skirt has dimensions such that when the cap sealingly engages the upper edge of the neck, at least a portion of the lower edge of the skirt is located between the upper end portion and the lower end portion of the annular recessed area. The closure system further comprises a protective sheath for application on the cap and on a portion of the neck of the bottle below the cap. The protective sheath is shrinkable to create a recessed zone within the annular recessed area adjacent the portion of the lower edge of the skirt located between the upper end portion and the lower end portion of the annular recessed area.

In accordance with a fourth broad aspect, the invention provides a water bottle comprising a neck having an upper edge defining a discharge opening and an annular recessed area on the neck below the upper edge, the annular recessed area having an upper edge portion and a lower edge portion.

The water bottle also has a threadless cap having a lid overlying and sealingly engaging the upper edge. The threadless cap also has a skirt depending from the lid, the skirt having a lower edge, at least a portion of the lower edge being located within the annular recessed area between the upper edge portion and the lower edge portion. The water bottle further comprises a protective sheath applied on the bottle, the protective sheath extending over the cap and over a portion of the neck located below the cap. The protective sheath forms a recessed zone overlying the annular recessed area and being adjacent to the portion of the lower edge of the skirt located within the annular recessed area between the upper edge portion and the lower edge portion.

In accordance with a fifth broad aspect, the invention provides a threadless cap for a water bottle having a neck with an upper edge defining a discharge opening, the neck also including an annular recessed area below the upper edge. The threadless cap comprises a lid for overlying and sealingly engaging the upper edge of the bottle. The lid includes a tension ring for retaining the cap on the neck of the bottle, the tension ring having an inwardly extending rib for engaging the neck of the bottle. The threadless cap also comprises a skirt depending from the lid, the skirt having a lower edge, a portion of the lower edge residing in the annular recessed area when the cap is applied on the bottle and the lid sealingly engages the upper edge of the bottle.

These and other aspects and features of the present invention will now become apparent to those of ordinary skill in the art upon review of the following description of specific embodiments of the invention in conjunction with the accompanying drawings.

BRIEF DESCRIPTION OF THE DRAWINGS

A detailed description of specific embodiments of the present invention is provided herein below, by way of example only, with reference to the accompanying drawings, in which.

Figure 1B:
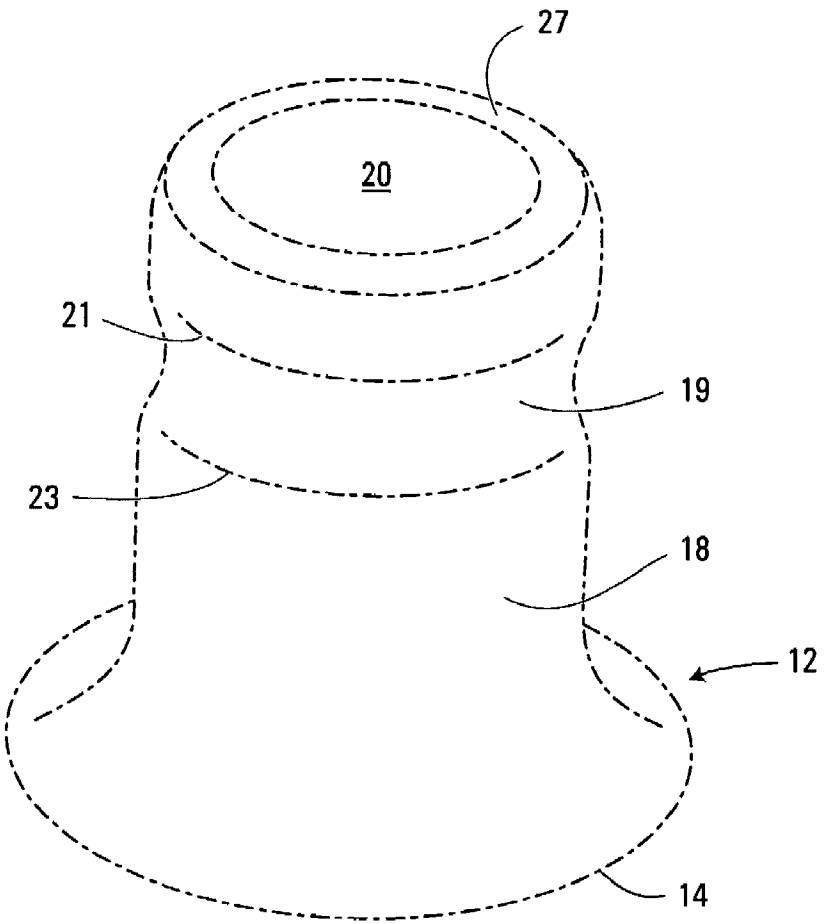
FIG. 1B shows an isometric view of the neck of the potable liquid bottle shown in FIG. 1A.

In the drawings, the embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF SPECIFIC EMBODIMENTS

Figure 1A:
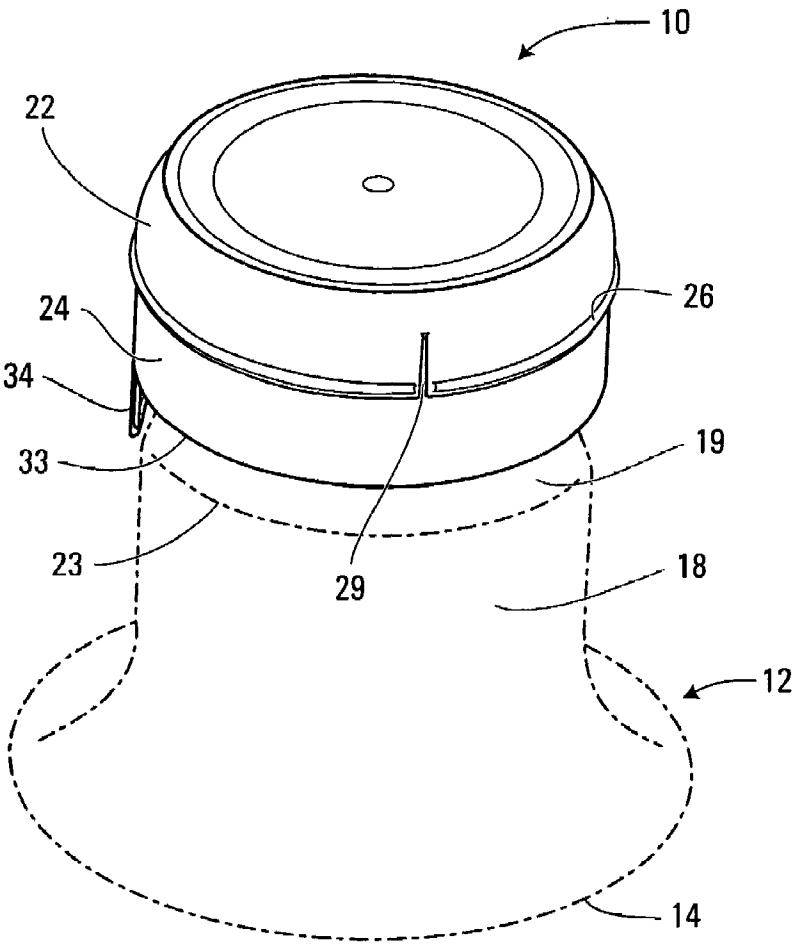
FIG. 1A shows an isometric view of a threadless cap for closing a potable liquid bottle in accordance with a specific example of implementation of the present invention.
Figure 2:
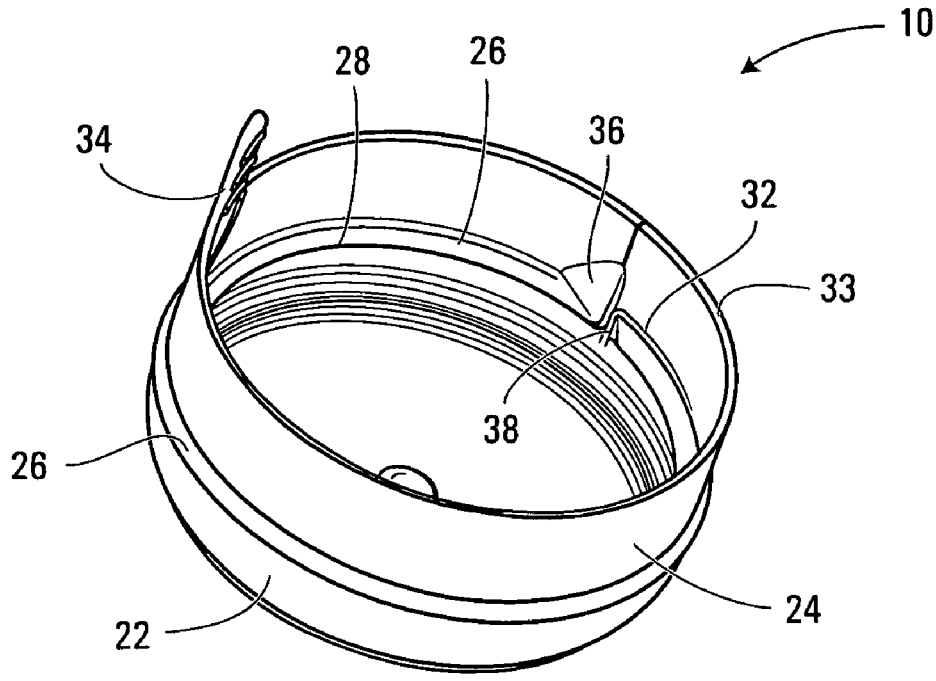
FIG. 2 shows an isometric view of the underside of the threadless cap shown in FIG. 1A.
Figure 3:
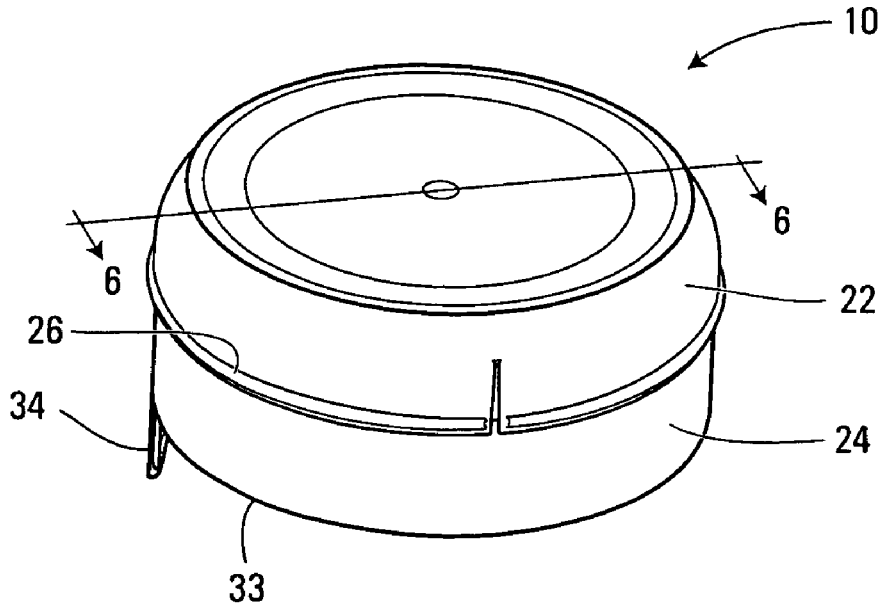
FIG. 3 shows an isometric view of the threadless cap shown in FIG. 1A.
Figure 4:
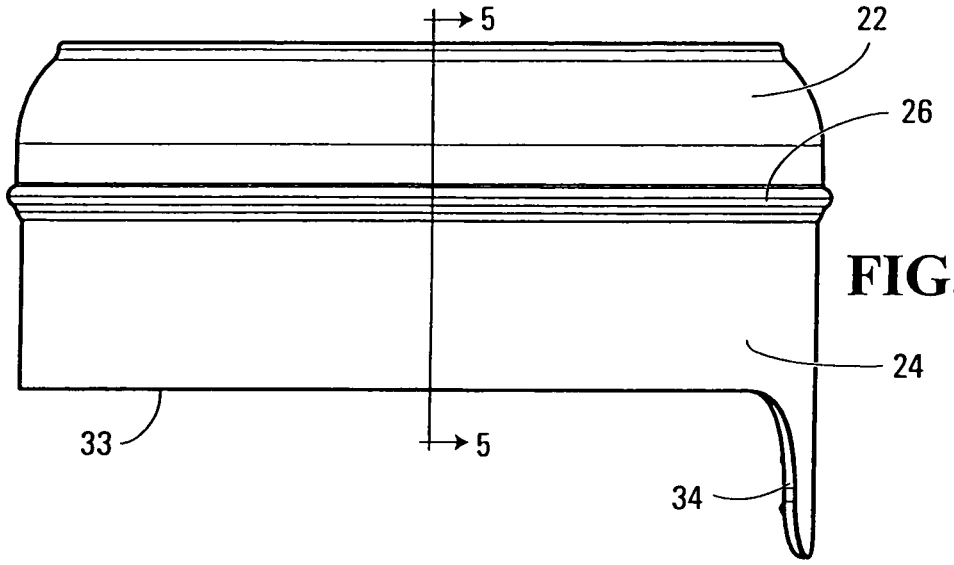
FIG. 4 shows an elevation view of the threadless cap shown in FIG. 3.

FIG. 1A shows a threadless cap 10 for closing a potable liquid bottle 12 in accordance with a specific example of implementation of the invention. In this application, threadless is intended to mean that the cap 10 does not have threads that are required to retain the cap 10 on the potable liquid bottle 12. The potable liquid contained in the bottle 12 can be water, juice, soft drink, or any other type of drinkable liquid. In the specific embodiments described in the present description, the potable liquid bottle 12 on which the cap 10 is to be mounted is a bottle for a water cooler or other liquid dispenser.

As can be seen in FIG. 1B, the potable liquid bottle 12 has a main body 14 defining a container (not shown) for holding liquid. The bottle 12 also has a neck 18 having an upper edge 27 defining a discharge opening 20 through which liquid contained in the container can be discharged, and an annular recessed area 19 below the upper edge 27. The annular recessed area 19, which extends around the perimeter of the neck 18, has an upper end portion 21 and a lower end portion 23. Upon installation of the bottle 12 in a dispenser device (not shown), actuation of the dispenser by a user causes liquid contained in container to flow through the discharge opening 20 into the dispenser and eventually through a faucet of the dispenser, where the liquid can be poured into a glass, cup, or the like.

Referring to FIGS. 1A and 1B and to FIGS. 2 to 6, the cap 10 comprises a lid 22 for overlying and sealingly engaging the upper edge 27 of the neck 18 of the bottle 12 and a skirt 24 depending from the lid 22. In the specific embodiment shown, the lid 22 and the skirt 24 are a unitary structure made of a polymeric material such as polyethylene. The lid 22 and the skirt 24 can be integrally formed, for instance, via an injection molding process. In other embodiments, the lid 22 and the skirt 24 are made of separate pieces and thereafter assembled together using, for instance, a gluing or sonic welding operation. Although not shown in the drawings, the lid 22 can be provided with a suitable gasket to better seal the upper edge 27.

The lid 22 includes a tension ring 26 for retaining the cap 10 on the neck 18 of the bottle 12. Upon positioning the cap 10 on the neck of the bottle 12, the tension ring 26 provides a radial force that causes the cap 10 to be retained on the neck 18. The tension ring 26 has an inwardly extending rib 28 for engaging the neck 18 of the bottle 12. The rib 28 is an internal projection or protrusion. In the non-limiting example of implementation shown, the rib 28 is in the form of a continuous projection extending along a substantial portion of the perimeter of the lid 22. In other embodiments, the rib 28 can be segmented, that is, the rib 28 can be formed of individual segments disposed along the periphery of the lid 22 rather than a continuous structure. Also, in this specific example of implementation, the tension ring 26 extends over substantially the entire periphery of the lid 22, although it is to be understood that the tension ring 26 can also be designed to extend along only a portion of the periphery of the lid 22. As well, while the lid 22 shown in FIGS. 1 to 6 is essentially a circular structure, it will be appreciated that various other configurations are possible without departing from the spirit of the invention.

Figure 5:
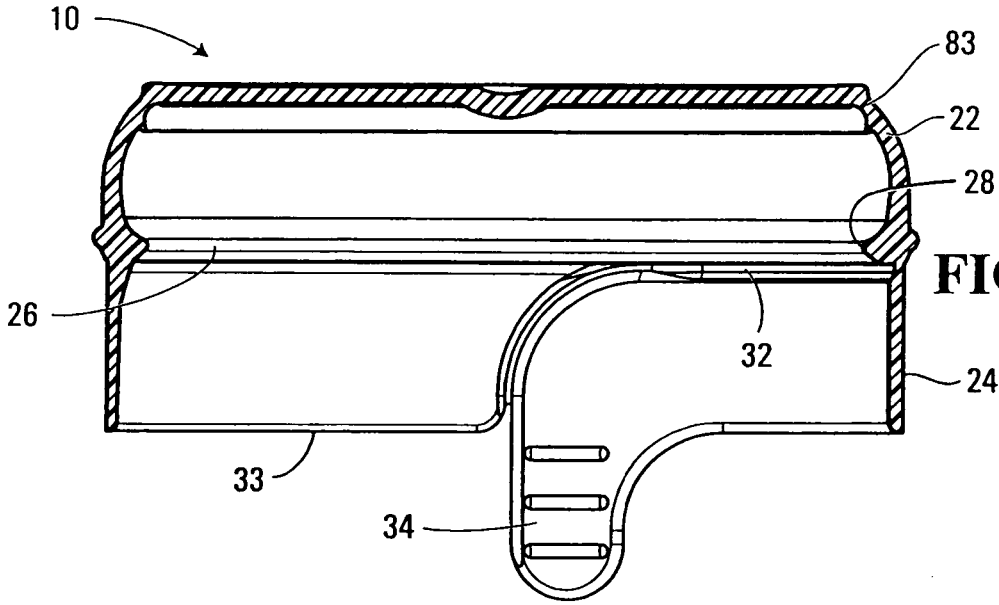
FIG. 5 shown a cross-sectional elevation view of the threadless cap along line 5-5 in FIG. 4.
Figure 6:
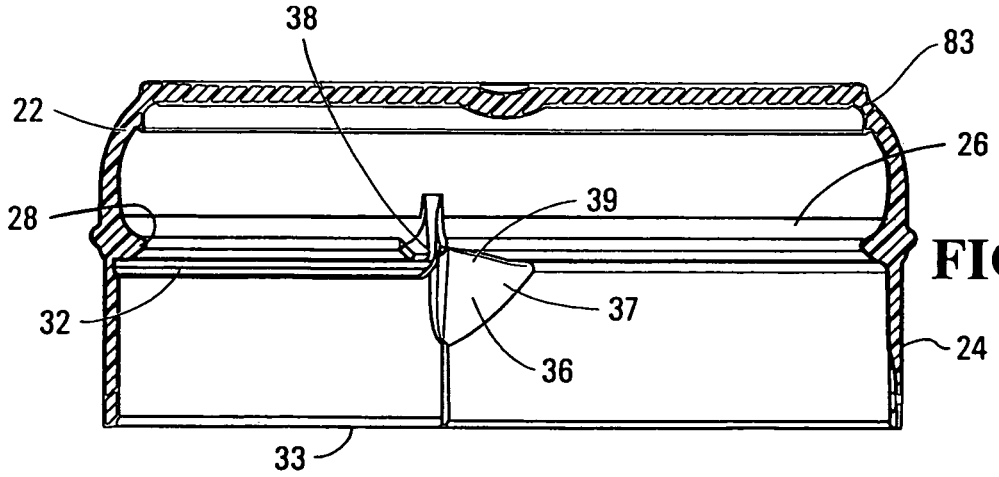
FIG. 6 shown a cross-sectional elevation view of the threadless cap along line 6-6 in FIG. 3.

In FIGS. 5 and 6, the cross-sectional view of the cap 10 shows that the thickness of the cap 10 in the shoulder area 83 is somewhat reduced by comparison to prior art caps in order to increase the flexibility of the cap 10 in that region. Accordingly, this allows the rib 28 to be made thicker and to project radially inwardly further such as to create a stronger retention force on the neck 18 of the bottle 12. When the cap 10 is applied on the neck 18 of the bottle 12, the tension ring is progressively spread radially until it snaps into place. The increased flexibility of the shoulder area 83 allows the thicker retention ring to be conveniently applied on the neck 18 of the bottle 12.

The skirt 24 depends from the lid 22 and surrounds the neck 18 of the bottle 12 when the cap 10 is installed thereon. In the particular embodiment shown, the skirt 24 has a lower edge 33 and is dimensioned such that when the cap 10 sealingly engages the upper edge of the neck 18, at least a portion of the lower edge 33 of the skirt 24 is located between the upper end portion 21 and the lower end portion 23 of the annular recessed area 19 of the neck 18 of the bottle 12.

The skirt 24 includes a line of weakness 32 facilitating a manual tear of the skirt 24. The line of weakness 32 is a line along which the skirt material is likely to tear or rupture when the skirt 24 is pulled. In the non-limiting example of implementation shown in FIGS. 1 to 6, the line of weakness 32 is realized by making the skirt material thinner along a certain line selected to be the line of weakness 32 than at other portions of the skirt 24. Alternatively, the line of weakness 32 can be realized by making a series of indentations or a series of perforations in the skirt material along a certain line selected to be the line of weakness 32. In the specific embodiment shown, the line of weakness 32 extends along a portion of the periphery of the skirt 24 in the vicinity of the tension ring 26. More specifically, the line of weakness 32 extends along approximately three-quarters of the periphery of the skirt 24 in an area adjacent to the tension ring 26. Furthermore, in this case, the line of weakness 32 includes a portion 38 extending across the tension ring 26. When the skirt 24 is torn and the material is ruptured at the portion 38, the tension ring 26 is severed which reduces its ability to hold the cap 10 on the bottle 12.

In addition, in the non-limiting embodiment shown, the skirt 24 defines a pull tab 34 for facilitating a manual tear of the skirt material along the line of weakness 32 when the cap 10 is removed from the bottle 12. The pull tab 34 projects down and depending on its size may extend down past the lower end portion 23 of the annular recessed area 19.

In the particular example of implementation shown in FIGS. 1 to 6, the cap 10 further comprises a tear stop 36 at a location intersecting a line of tear propagating as a result of a manual pull applied on the skirt 24. The line of tear produced by a manual pull of the skirt 24 is most likely to follow the line of weakness 32 of the skirt 24. The tear stop 36 prevents the line of tear to propagate beyond the tear stop 36. More specifically, the tear stop 36 is a structure adapted to prevent propagation of the line of tear beyond the location of the structure. In the specific embodiment shown, the tear stop 36 includes a thickened portion on the cap 10. More specifically, the tear stop 36 is realized by a thickening of the skirt material in a certain area of the skirt 24. Thickening of the skirt material is intended to mean that the skirt material in that certain area of the skirt 24 is thicker than in adjacent areas of the skirt 24 through which the line of weakness 32 extends. Once the propagating line of tear reaches the tear stop 36, the thicker material of the skirt 24 at that location will prevent further tearing of the skirt material without a significant increase in the pulling force applied on the skirt 24. In other embodiments, the tear stop 36 can be realized by a separate piece of material affixed, for example, by gluing or sonic welding to a specific location of the cap 10. In yet other embodiments, the tear stop 36 can be realized by forming a hole of sufficient dimensions in the skirt material. When the tear reaches such a tear stop 36, the absence of material in the hole negates availability of material through which the tear can propagate and thus prevents further propagation of the tear beyond that location.

In the specific example of implementation, the tear stop 36 is located adjacent the rib 28 and as such assists the rib 28 in performing the function of a tension ring. The tear stop 36 has a cross-sectional shape that is analogous to the cross-sectional shape of the rib 28. More specifically, the tear stop 36 has a smooth ramp surface 37 and allows the tension ring of the cap 10 to progressively spread radially outwardly as the cap is being snap fitted on the neck 18 of the bottle 12. Above the ramp surface 37, the tear stop 36 defines a tooth 39 that engages the neck 18 of the bottle 12 to assist the tension ring in retaining the cap on the neck 18 of the bottle 12.

It will thus be appreciated that the tension ring 26, the line of weakness 32, and the tear stop 36 facilitate the mounting, retention, and removal of the cap 10 on or from the neck 18 of the bottle 12. In particular, the tension ring 26 facilitates installation and ensures retention of the cap 10 on the neck 18 of the bottle 12. For their part, the line of weakness 32 and the tear stop 36 facilitate the removal of the cap 10 from the neck 18 of the bottle 12.

Specifically, when a user applies a pulling force on the pull tab 34 of the skirt 24, a tear or rupture of the skirt material is initiated and propagates along the line of weakness 32 under continual application of the force. In the particular embodiment shown, the line of weakness 32 is configured such that a strip is formed when the skirt 24 is being torn. Upon reaching the tear stop 36, the tear of the skirt material, or tear line, propagating along the line of weakness 32 is prevented from further propagation through the tear stop 36. Advantageously, this prevents a situation whereby a tear line would propagate along the entire periphery of the skirt 24 causing for the skirt to be completely detached from the lid 22, with the latter remaining fixed on the neck 18 of the bottle 12. In other words, the tear stop 36 prevents complete separation of the strip formed from the torn skirt material from the remainder of the cap 10. In addition, owing to the portion 38 of the line of weakness 32 extending across the tension ring 26 which, in this particular embodiment, is located adjacent the tear stop 36, the tear line propagates along the portion 38 and thus tears or ruptures at least part of the tension ring 26. As a result, the retaining force exerted by the tension ring 26 on the neck 18 of the bottle 12 is reduced thereby facilitating removal of the cap 10 from the neck 18.

Figure 7:
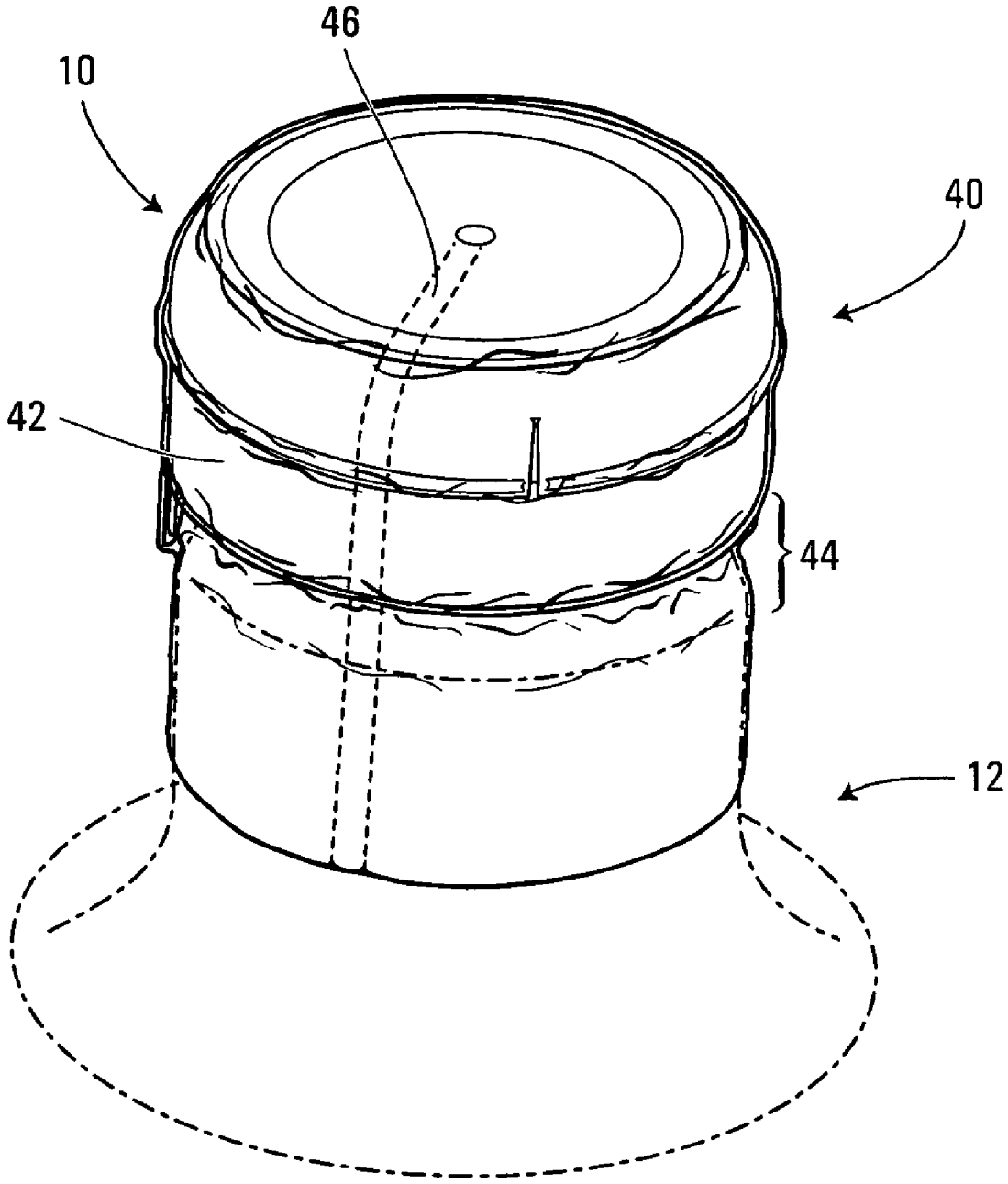
FIG. 7 shows an isometric view of a closure system for a potable liquid bottle in accordance with a specific example of implementation of the present invention.

The cap 10 may also be part of a closure system for a potable liquid bottle. FIG. 7 shows a closure system 40 for a potable liquid bottle 12, in accordance with a specific example of implementation of the invention. The bottle 12 is essentially identical to that described previously in connection with FIG. 1B. The closure system 40 comprises a threadless cap 10, such as the cap described previously in connection with FIGS. 1 to 6, and a protective sheath 42 for application on the cap 10 and on a portion of the neck 18 of the bottle 12 below the cap 10. The protective sheath 42 is shrinkable to create a recessed zone 44 within the annular recessed area 19 of the neck 18 adjacent the portion of the lower edge 33 of the skirt 24 located between the upper end portion 21 and the lower end portion 23 of the annular recessed area 19.

In a particular example of implementation, the portion of the lower edge 33 of the skirt 24 that is located between the upper end portion 21 and the lower end portion 23 of the annular recessed area 19 includes the entirety of the lower edge 33 of the skirt 24 except the pull tab 34. Also, the sheath 42 is heat shrinkable on the cap 10 and on the portion of the neck 18 of the bottle 12 below the cap 10. Furthermore, like the skirt 24, the sheath 42 includes a line of weakness 46 to facilitate tear and removal of the sheath 42 after the sheath has been heat shrunk on the cap 10 and on the portion of the neck 18 of the bottle 12 below the cap 10. The line of weakness 46 is realized by making the sheath material thinner along a certain line selected to be the line of weakness 46 than at other portions of the sheath 42. Alternatively, the line of weakness 46 can be realized by making a series of indentations or a series of perforations in the sheath material along a certain line selected to be the line of weakness 46.

Advantageously, the recessed zone 44 within the annular recessed area 19 of the neck 18 reduces the tendency of the sheath 42 to slide on the cap 10 and on the portion of the neck 18 of the bottle 12 below the cap 10. Thus, the recessed zone 44, which is made possible by the dimensions of the skirt 24 of the cap 10, enhances retention of the sheath 42 on the cap 10 and on the portion of the neck 18 of the bottle 12 below the cap 10. In addition, the rib 28 of the tension ring 26 projects radially outwardly out of the cap 10 which further enhances retention of the sheath 42. The enhanced retention of the sheath 42 helps in ensuring that hygienic conditions are maintained in the area of the neck 18 of the bottle 12 and the cap 10 that is exposed to direct contact with human hands during manipulation of the bottle 12.

Although the above description related to a specific type of cap, it will be appreciated that the invention can also be applied to caps having other features. For instance, the invention can be applied to a cap which has a lid portion that is pierced when a bottle on which the cap is mounted is installed in a liquid dispenser. The invention can also be applied to caps having a central well as described, for instance, in U.S. Pat. No. 6,032,812.

The above description of the embodiments should not be interpreted in a limiting manner since other variations, modifications and refinements are possible within the spirit and scope of the present invention. The scope of the invention is defined in the appended claims and their equivalents.

The invention claimed is:

1. A threadless cap for closing a potable liquid bottle, the potable liquid bottle having a neck with an upper edge defining a discharge opening, said threadless cap comprising:

a lid for overlying and sealing the discharge opening, said lid including a tension ring for retaining said cap on the neck of the bottle, said tension ring having an inwardly extending rib for engaging the neck of the bottle;

a skirt depending from said lid, said skirt including a line of weakness facilitating a manual tear of said skirt, said line of weakness extending along a portion of a perimeter of said skirt, said line of weakness including a portion extending across said tension ring to reduce a retaining force exerted by said tension ring on the neck of the bottle when a line of tear propagating as a result of a manual pull applied on said skirt extends across said tension ring, said line of weakness being configured such that the line of tear propagates along the portion of the perimeter of said skirt and then propagates along the portion extending across said tension ring; and a tear stop for preventing the line of tear to propagate beyond said tear stop, said tear stop having a portion for engaging the neck of the bottle.

2. A threadless cap as defined in claim 1, wherein said tear stop includes a thickened portion on said cap.

3. A threadless cap as defined in claim 1, wherein said line of weakness is configured such that a strip is formed when said skirt is being torn.

4. A threadless cap as defined in claim 3, wherein said tear stop prevents complete separation of said strip from a remainder of said cap.

5. A threadless cap as defined in claim 4, wherein said skirt includes a pull tab that is attached to said strip.

6. A threadless cap as defined in claim 5, wherein said strip extends partially around the perimeter of said skirt.

7. A threadless cap as defined in claim 1, wherein the portion of the perimeter of said skirt along which extends said line of weakness is adjacent to said tension ring.

8. A threadless cap as defined in claim 7, wherein said lid and said skirt are integrally formed.

9. A threadless cap as defined in claim 8, wherein said lid and said skirt are integrally formed by injection molding.

10. A threadless cap for closing a potable liquid bottle, the potable liquid bottle having a neck with an upper edge defining a discharge opening, said threadless cap comprising:

a lid for overlying and sealing the discharge opening, said lid including a tension ring for retaining said cap on the neck of the bottle, said tension ring having an inwardly extending rib for engaging the neck of the bottle;

a skirt depending from said lid, said skirt including a line of weakness facilitating a manual tear of said skirt, said line of weakness extending along a portion of a perimeter of said skirt adjacent to said tension ring, said line of weakness including a portion extending across said tension ring to reduce a retaining force exerted by said tension ring on the neck of the bottle when a tear line propagating as a result of a manual pull applied on said skirt extends across said tension ring, said line of weakness being configured such that the tear line propagates along the portion of the perimeter of said skirt and then propagates along the portion extending across said tension ring, said line of weakness being configured such that a strip is formed when said skirt is being torn; and a tear stop for preventing the tear line to propagate beyond said tear stop, said tear stop having a portion for engaging the neck of the bottle.

11. A threadless cap as defined in claim 10, wherein said tear stop includes a thickened portion on said cap.

12. A threadless cap as defined in claim 11, wherein said tear stop prevents complete separation of said strip from a remainder of said cap.

13. A threadless cap as defined in claim 12, wherein said skirt includes a pull tab that is attached to said strip.

14. A threadless cap as defined in claim 13, wherein said strip extends partially around the perimeter of said skirt.

15. A threadless cap as defined in claim 10, wherein the portion of the perimeter of said skirt along which extends said line of weakness is below and adjacent to said tension ring.

16. A threadless cap as defined in claim 15, wherein said lid and said skirt are integrally formed.

17. A threadless cap as defined in claim 16, wherein said lid and said skirt are integrally formed by injection molding.

18. A threadless cap as defined in claim 1, wherein the portion of the perimeter of said skirt comprises at least half of the perimeter of said skirt.

19. A threadless cap as defined in claim 1, wherein the portion of the perimeter of said skirt comprises at least three-quarters of the perimeter of said skirt.

20. A threadless cap as defined in claim 1, wherein the portion of said line of weakness extending across said tension ring is adjacent to said tear stop.

21. A threadless cap as defined in claim 1, wherein said tear stop has a surface allowing said tension ring to progressively spread radially outwardly when said cap is being snap fitted on the neck of the bottle.

22. A threadless cap as defined in claim 10, wherein the portion of the perimeter of said skirt comprises at least half of the perimeter of said skirt.

23. A threadless cap as defined in claim 10, wherein the portion of the perimeter of said skirt comprises at least three-quarters of the perimeter of said skirt.

24. A threadless cap as defined in claim 10, wherein the portion of said line of weakness extending across said tension ring is adjacent to said tear stop.

25. A threadless cap as defined in claim 10, wherein said tear stop has a surface allowing said tension ring to progressively spread radially outwardly when said cap is being snap fitted on the neck of the bottle.

26. A threadless cap for closing a water bottle, the water bottle having a neck with an upper edge defining a discharge opening, said threadless cap comprising:

a lid for overlying and sealing the discharge opening, said lid including a tension ring for retaining said cap on the neck of the bottle, said tension ring having an inwardly extending rib for engaging the neck of the bottle; and a skirt depending from said lid, said skirt including:

a first weakness line segment below and adjacent to said tension ring and extending along said tension ring for at least half of a perimeter of said tension ring;

a second weakness line segment extending across said tension ring;

a pull tab to initiate a tear which propagates along said first weakness line segment in order to partially separate said skirt form said lid and then along said second weakness line segment to rupture said tension ring and allow removal of said cap from the neck; and a tear stop for preventing the tear to propagate beyond said tear stop, said tear stop having a portion for engaging the neck of the water bottle.

27. A threadless cap as defined in claim 26, wherein said first weakness line segment and said second weakness line segment are part of a continuous line of weakness.

28. A threadless cap as defined in claim 27, wherein said continuous line of weakness is configured to prevent a complete separation of said skirt from said lid as said cap is being removed from the neck.

29. A threadless cap as defined in claim 28, wherein said first weakness line segment extends along said tension ring over more than half of the perimeter of said tension ring.

30. A threadless cap as defined in claim 29, wherein said first weakness line segment defines an arc of circle.

31. A threadless cap as defined in claim 30, wherein said arc of circle is parallel to said tension ring.

32. A threadless cap as defined in claim 30, wherein said second weakness line segment extends upwardly from said first weakness line segment and intersects said tension ring.

33. A threadless cap as defined in claim 28, wherein said first weakness line segment extends along said tension ring over less than three-quarters of the perimeter of said tension ring.

34. A threadless cap as defined in claim 1, wherein said inwardly extending rib tapers radially inwardly.

* * * * *